United States Patent [19]

Wicks

[11] Patent Number: 4,789,372

[45] Date of Patent: Dec. 6, 1988

[54] MATERNITY GARMENT

[76] Inventor: Trenna R. Wicks, 2040 43rd East, Seattle, Wash. 98122

[21] Appl. No.: 38,209

[22] Filed: Apr. 14, 1987

[51] Int. Cl.[4] ..... A41C 1/08

[52] U.S. Cl. ..... 450/155; 450/122; 450/113; 2/44

[58] Field of Search ..... 450/155, 96, 107, 122, 450/113; 2/44, 45

[56] References Cited

U.S. PATENT DOCUMENTS

| | | | |
|---|---|---|---|
| 1,828,015 | 10/1931 | Allebach | 450/113 |
| 2,250,807 | 7/1941 | Lunney | 450/113 |
| 2,586,658 | 2/1952 | Hormann | 2/44 X |
| 3,273,563 | 9/1966 | Bonang | 450/155 |
| 3,304,941 | 2/1967 | Chubby | 450/122 X |
| 4,005,715 | 2/1977 | Moore | 450/155 |
| 4,557,268 | 12/1985 | Maddux et al. | 450/155 |

*Primary Examiner*—Louis K. Rimrodt
*Assistant Examiner*—J. L. Olds
*Attorney, Agent, or Firm*—Seed and Berry

[57] ABSTRACT

A garment for supporting the abdomen of a wearer is disclosed. The garment comprises a panty and two support straps which attach to the center front edge of the panty, over the shoulders, across the lower back in a criss-cross fashion, over the hips and under the abdomen. The garment may also include lateral straps to direct the support straps outward from the neck of the wearer, and a reinforcing strap to add extra support to the abdomen. The garment lifts the abdomen, transferring weight of the abdomen to the shoulders by way of the wearer's back. The garment decreses lordosis and improves posture.

20 Claims, 3 Drawing Sheets

MATERNITY GARMENT

DESCRIPTION

1. Technical Field

This invention relates in general to garments which lend support to the abdomen of the wearer. More specifically, the present invention discloses a garment which supports the abdomen of a pregnant woman and includes a panty and support straps which lift the abdomen and transfer weight from the abdomen to the shoulders via the back of the wearer.

2. Background Art

It has long been known that increased weight in the abdominal area, such as occurs during pregnancy, increases strain on the lower back, causing pain and stress on the musculature of the back. Commonly, as pregnancy develops, so, too, does lordosis, an abnormally exaggerated, forward curvature of the spine. The resulting posture and/or pain and its effects on life and work are expensive due to the need for rest, reduced activity, and even hospitalization, with accompanying lost income and psychosocial dysfunction.

In the past, efforts have been made to transfer the weight of the abdomen to other parts of the body, particularly the shoulders. Garments have been devised with straps leading from a pouch worn over the abdomen directly to the shoulders, in the front of the body of the wearer, thus hypothetically lifting the weight of the abdomen. In practice, such devices often pull the shoulders down rather than lifting the abdomen. Other devices attempt to transfer the weight of the abdomen to the back region of the wearer but can actually result in increased lordosis of the weight is not transferred properly.

There exists a need in the art for a garment which supports the abdomen and transfers the weight of the abdomen efficiently to the shoulders and back by way of the back of the wearer without increasing and, in fact, decreasing lordosis. The garment should lift the weight of the abdomen rather than merely pulling down the shoulders of the wearer.

3. Disclosure of the Invention

It is an object of the present invention to provide a garment which provides abdominal support to the wearer by transferring the weight of the abdomen through the back of the wearer and up to the shoulders of the wearer.

It is a further object of the present invention to achieve abdominal lift without pulling the shoulders of the wearer downward or causing the wearer to slouch.

Another object of the present invention is to provide a garment which decreases lordosis and alleviates pain in the lower back.

Yet another object of the present invention is to provide a garment which is comfortable to wear both in its fit and in its mechanical redistribution of the weight of the abdomen.

A further object of the present invention is to provide a garment which transfers abdominal weight to an outer portion of the wearer's shoulders and does not compress the portion of the wearer's shoulders near the wearer's neck.

The present invention achieves the foregoing objectives with a garment that includes a panty and two support straps. Each support strap has a first end and a second end. The first end of the first support strap is affixed to a center front portion of the panty. The first support strap extends upward over a shoulder of the wearer, across the wearer's lower back, and down over one of the wearer's hips. The second support strap also has a first end and a second end. The first end of the second support strap is affixed to a center front portion of the panty. The second support strap extends upwardly over the other shoulder of the wearer across the wearer's lower back and down across the opposite hip of the wearer. The second support strap further wraps underneath the abdomen of the wearer. The present invention also includes a means for connecting near their second ends of the first and second support straps to each other. The support straps extend across the wearer's back, and crisscross at the back of the wearer.

The present invention may also include first and second lateral straps, each having a first end, a second end, and a midpoint. The first and second ends of the first lateral strap are affixed to the first support strap. The midpoint of the first lateral strap is affixed to a side portion of the panty. The first and second ends of the second lateral strap are affixed to the second support strap, and the midpoint of the second lateral strap is affixed to a side portion of the panty. The lateral straps act to direct the support straps outward from the neck of the wearer.

The garment of the present invention may further include a reinforcing strap having two ends and designed to wrap under the abdomen of the wearer. The reinforcing strap also includes means for affixing the ends of the reinforcing strap to the two support straps near the hips of the wearer.

The panty of the present invention may further include at least one center reinforcing ribbon which extends from the center front portion of the panty to a crotch portion of the panty. The center reinforcing ribbon is attached to the panty at the center front portion and at the crotch portion. The panty may also include a pair of laterally positioned, lateral reinforcing ribbons. The first end of each lateral reinforcing ribbon extends from a side upper edge of the panty to the center reinforcing ribbon in an area near the crotch of the panty. The reinforcing ribbon lends structural support to the panty. The size of the panty of the present invention may be such that an upper edge of the panty extends above the navel of the wearer.

BEST MODE FOR CARRYING OUT THE INVENTION

Figure 1:
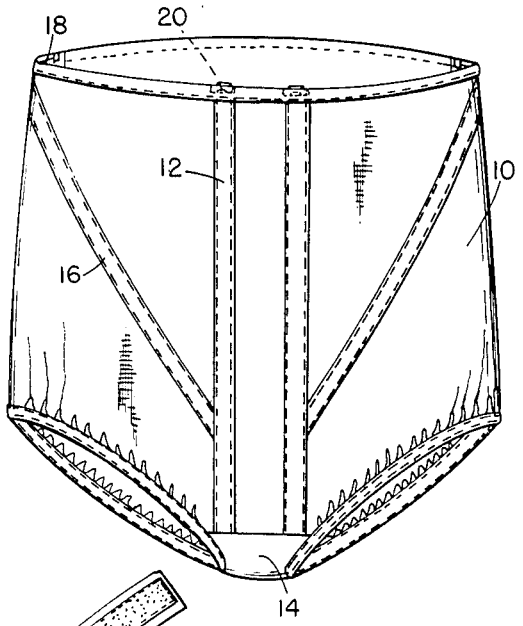
FIG. 1 is an illustration of the panty of the preferred embodiment of the present invention.
Figure 2:
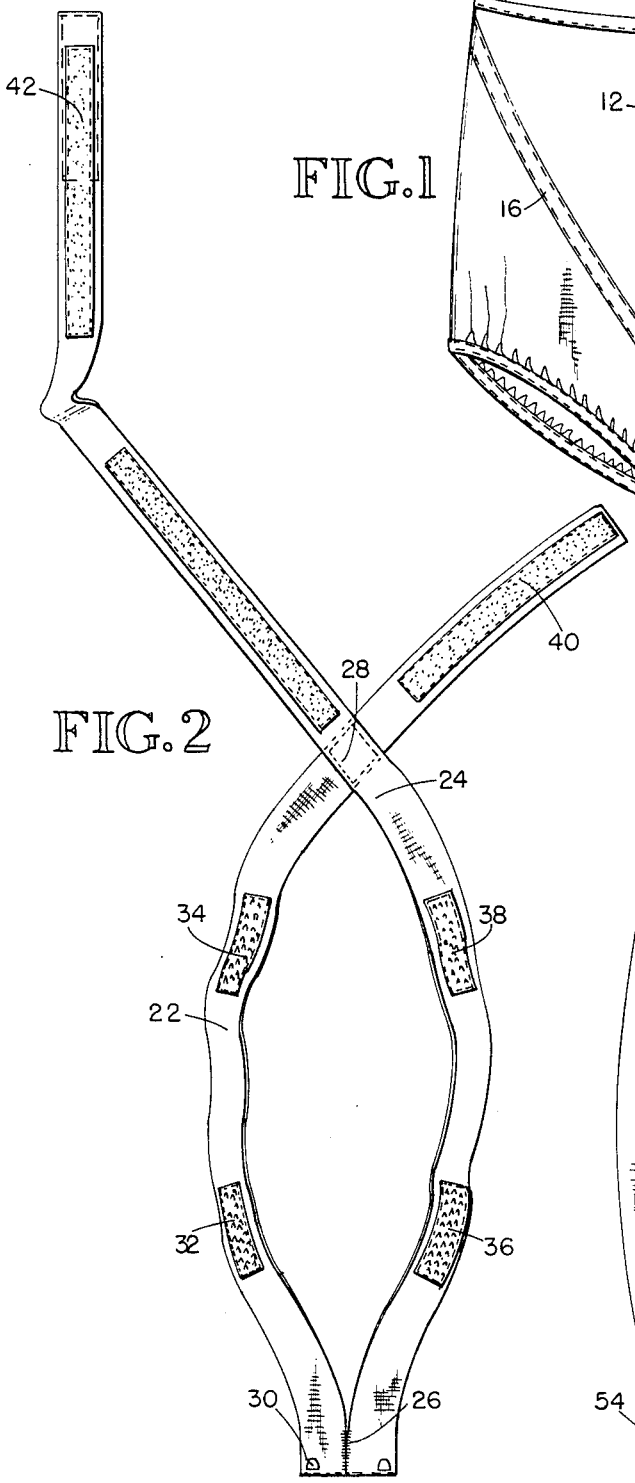
FIG. 2 shows the two support straps in a preferred embodiment of the present invention.
Figure 3:
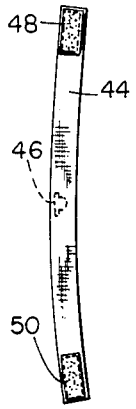
FIG. 3 illustrates one of the two lateral straps of the present invention.

FIGS. 1, 2 and 3 illustrate the elements of the preferred embodiment of the present invention. FIG. 1 illustrates panty 10, preferably constructed from an elastic fabric, such as cotton Lycra TM. Two center reinforcing ribbons 12 are attached to the center front of the panty and extend from the upper edge of the panty to the crotch section 14 of the panty. Alternatively, one reinforcing ribbon which is centrally situated on the front portion of the panty may be used. The reinforcing ribbons are preferably constructed from nonelastic fabric and will not stretch along their longitudinal axis. The reinforcing ribbons lend structural support to the center front portion of the panty. The preferred embodiment of the present invention also includes lateral reinforcing ribbons 16, which extend from the side upper side edges of the panty in toward the center reinforcing ribbons in an area near the crotch of the panty. These lateral reinforcing ribbons are similarly constructed of non-stretching fabric and lend further structural support to the panty, particularly when used in conjunction with lateral straps 44 (discussed below). The preferred embodiment of the panty also has fasteners 18 and 20 located at the upper edges of the panty. Fasteners 18 are at the side upper edges of the panty, and fasteners 20 are at the center front upper edges of the panty. Fasteners 18 allow the wearer to detachably affix the midpoint of the lateral straps to the panty. Fasteners 20 allow the wearer to detachably affix the support straps to the panty. The fasteners shown in FIG. 1 are the eye portions of hook- and-eye and arrangements. Alternative fasteners, such as snaps or Velcro TM, may also be used.

FIG. 2 illustrates the two support straps of the preferred embodiment of the present invention. The first support strap 22 is shorter in length than the second support strap 24. The two support straps are connected along seam 26. This connection allows for ease of putting on and taking off the garment. The two support straps are also preferably joined at the crisscross junction 28, for example, by being sewn together. Each of the two support straps has fasteners 30 which are used to connect the two support straps to the connectors 20 at the front portion of the panty. The connectors shown in FIG. 2 are the hook portion of a hook-and-eye arrangement.

The first support strap further has connector 40, and the second support strap has connector 42, which allow the two support straps to overlap and connect to each other near their second ends. The connectors 40 and 42 are preferably long enough in length to allow the straps to be adjusted and fitted according to the needs and size of the wearer. The connectors shown in FIG. 2 are strips of Velcro TM, but alternatively could be other connectors, such as strips of snaps. The two support straps are preferably constructed from a material which is elastic along its longitudinal axis.

FIG. 3 illustrates one of the two lateral straps in the preferred embodiment of the present invention. The lateral strap 44 is constructed of fabric which is elastic along its longitudinal axis. The lateral strap has three points of connection. A connector 46 is located approximately at the midpoint along the longitudinal axis of the lateral strip. This connector 46 is used to attach the lateral strap to connector 18, located at an upper side portion of the panty. The lateral strap also has connectors 48 and 50, which are used to attach the lateral strap to the first support strap at connectors 32 and 34 or to the second support strap at connectors 36 and 38. The connectors 48 and 50, shown in FIG. 3, are patches of Velcro TM, but alternative connectors could also be used.

The first support strap 22 has a connector 32 which is used to connect the first support strap to the first end of the first lateral strap. The first support strap 22 also has connector 34, which is used to connect the second end of the first lateral strap to the first support strap. Similarly, the second support strap 24 has connector 36, which is used to connect the second support strap to the first end of the second lateral strap, and connector 38, which is used to connect the second support strap to the second end of the second lateral strap. The connectors 32 through 38, shown in FIG. 2, are patches of Velcro TM; however, other means of attachment, such as snaps, could alternatively be used.

Figure 4:
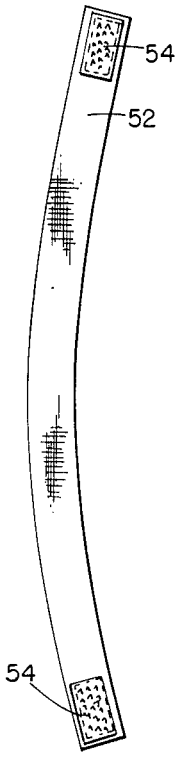
FIG. 4 illustrates the reinforcing strap of the present invention.

FIG. 4 illustrates the reinforcing strap 52, which is preferably constructed of a material which is elastic along its longitudinal axis. The reinforcing strap has connectors 54, such as Velcro TM, at its two ends which are used to connect the reinforcing strap to the two support straps at an area just above the hips. The reinforcing strap is used where extra lift and support are needed. Reinforcing strap 52 may prove particularly beneficial to women who have hyperlordosis or who are carrying twins or who experience severe lower back pain and discomfort.

Figure 5:
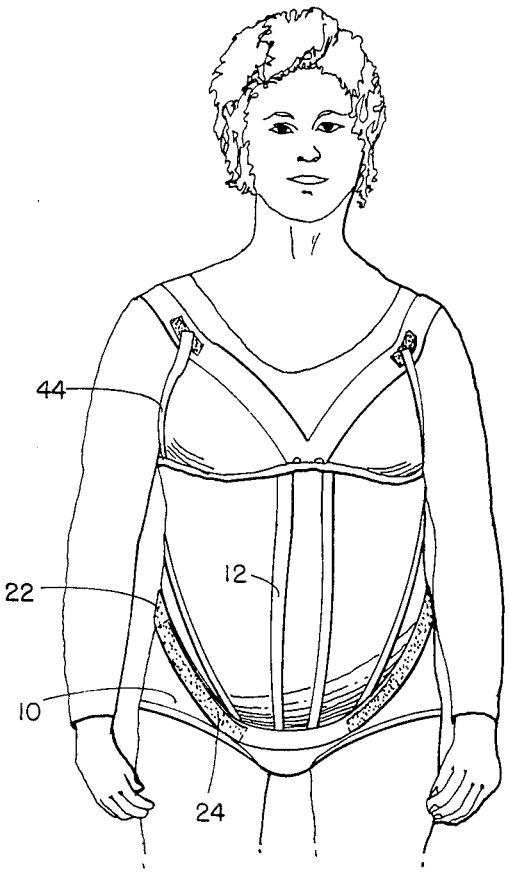
FIG. 5 is a front view of the present invention being worn by a pregnant woman.
Figure 6:
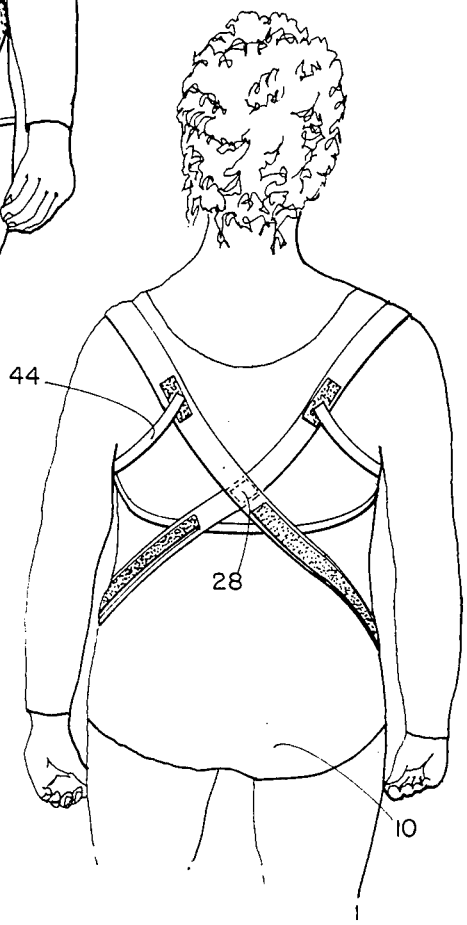
FIG. 6 is a rear view of the garment of the present invention being worn by a pregnant woman.
Figure 7:
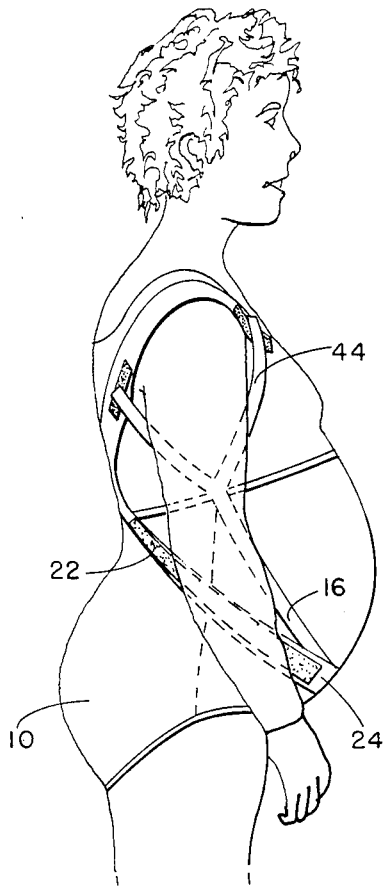
FIG. 7 is a side view of the garment of the present invention being worn by a pregnant woman.
Figure 8:
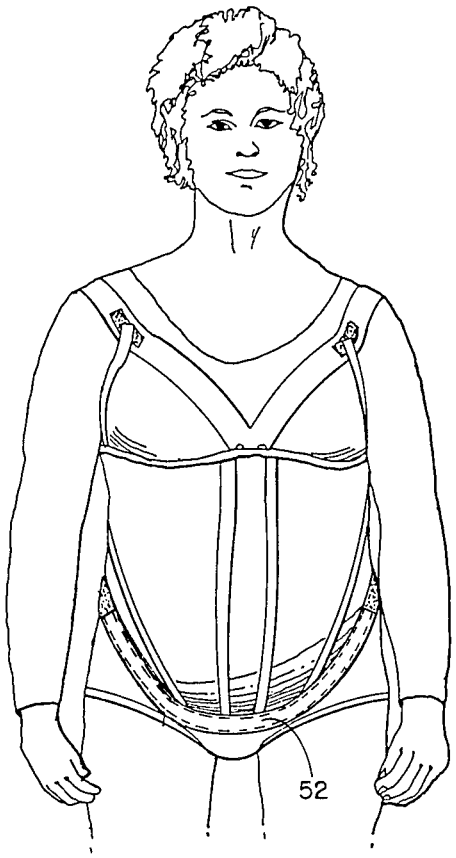

FIGS. 5 through 7 illustrate the preferred embodiment of the present invention as being worn by a pregnant woman. Referring to FIG. 5, the panty 10 is worn as a normal panty. Preferably, the upper edge of the panty is situated well above the navel of the wearer for greater comfort and support. As can be seen in the figure, the two support straps 22, 24 are connected to the center front portion of the panty 10 to provide lift and support along the center line of the abdomen. The support straps 22, 24 then extend up and over the shoulders of the wearer. The lateral straps 44 are attached at their end fasteners 48, 50 to respective fasteners 32, 34 on the support straps in front of and in back of the axillae, or armpits, of the wearer. The center fasteners 46 on the lateral straps 44 are attached to respective fasteners 18 at the upper side edges of the panty 10. These lateral straps 44 direct the support straps 22, 24 outward from the neck of the wearer and thus prevent the support straps 22, 24 from resting on the wearer's neck muscles, where there are sensitive nerves and blood vessels. The lateral straps 44 also provide extra lift to the abdomen.

Referring now to FIG. 6, the support straps extend over the shoulders of the wearer down to a lower back region, where they crisscross at junction 28. Preferably, the support straps are sewn together at this junction. The support straps then extend out to the opposite hips of the wearer, where they pass over the hips of the wearer. Also shown in FIG. 6 are the second ends of the lateral straps 44, which attach to the support straps 22, 24 at 34, 38, respectively. As in the front of the body, the lateral straps 44 help to direct the support straps away from the neck region and provide added support to the abdomen.

Referring now to FIG. 7, the second support strap 24 extends beyond the hip area of the wearer and wraps under the abdomen, on toward the first support strap 22. The two support straps overlap each other near their second ends at the area of one hip of the wearer. The amount of overlap of the two support straps may be adjusted according to the comfort and support needed by the wearer. FIG. 7 also illustrates lateral strap 44, whose midpoint fastener 46 is attached to the upper side edge fastener 18 of the panty and whose first and second ends 48, 50 are attached to a support strap 24.

The garment of the present invention provides lift and support to the abdominal area of the wearer. In particular, the support strap lifts the abdomen and transfers the weight along the longitudinal axis of the support straps over the hips and toward the direction of the lower back region. The weight is then further transferred from the lower back region up along the back toward the shoulders. Thus, some of the weight of the abdomen is transferred to the back and shoulders by way of the crisscross junction at the lower back region. The present invention achieves lift of the abdomen but does not pull down the shoulders of the wearer, and does not cause the wearer's shoulders to slouch. Rather, the weight that is transferred is distributed in a biomechanically safe and comfortable manner to stronger regions of the body. By specifically redirecting the forces caused by an enlarged abdomen, the present invention reduces lordosis, thus improving posture, and eases lower back pain caused by muscle weakness, ligamentous overstretching, and spinal joint compression. The present invention may be particularly beneficial to women with weak back muscles or with pelvic or groin varicosities or with idiopathic pain at the symphysis pubis. The garment not only reduces lower back and pelvic pain, but can be helpful in prolonging sports and fitness activities later into normal, pain-free pregnancy.

Other variations of the present invention are also contemplated. For example, the garment may be worn without the lateral straps or the reinforcing strap when additional lift is not needed.

From the foregoing it will be appreciated that, although specific embodiments of the invention have been described herein for purposes of illustration, various modifications may be made without deviating from the spirit and scope of the invention. Accordingly, the invention is not to be limited except as by the appended claims.

I claim:

1. A garment for supporting the abdomen of a wearer, comprising:

a panty;

a first support strap having a first end and a second end, said first end being attached to a center front portion of the panty, said first support strap being adapted to extend over a shoulder of the wearer, across the lower back of the wearer, and over a hip of the wearer;

a second support strap having a first end and a second end, said first end being attached to a center front portion of the panty, said second support strap being adapted to extend over a shoulder of the wearer, across the lower back of the wearer, over a hip of the wearer, and under the abdomen of the wearer, said first and second support straps being adapted to crisscross each other at the back of the wearer and said second ends of the support straps being adapted to overlap each other under the wearer's abdomen; and means for adjustably connecting the first and second support straps to each other near their second ends.

2. The garment of claim 1, further comprising a first lateral strap having a first end, a second end and a midpoint, said first and second ends being affixed to the first support strap and said midpoint being affixed to a side portion of the panty; a second lateral strap having a first end, a second end and a midpoint, said first and second ends being affixed to the second support strap and said midpoint being affixed to a side portion of the panty, wherein the lateral straps direct the support straps outward from the neck of the wearer.

3. The garment of claim 1, further comprising:

a reinforcing strap having two ends and adapted to wrap under the abdomen of the wearer; and means for affixing the ends of the reinforcing strap to the two support straps near the hips of the wearer.

4. The garment of claim 1, further comprising at least one reinforcing ribbon extending from the center front portion of the panty, and attached thereto, to a crotch portion of the panty, and attached thereto, wherein the reinforcing ribbon lends structural support to the panty.

5. The garment of claim 1 wherein an upper edge of the panty extends above the navel of the wearer.

6. The garment of claim 1, further comprising a pair of lateral reinforcing ribbons positioned on the panty lateral to each other, each having a first end and a second end, wherein each first end is attached to an upper side portion of the panty and each second end is attached to a lower front portion of the panty near a crotch portion of the panty.

7. A garment for supporting the abdomen of a wearer, comprising:

a panty;

a first support strap having a first end and a second end, said first end being attached to a center front portion of the panty, said first support strap being adapted to extend over a shoulder of the wearer, across the lower back of the wearer, and over a hip of the wearer;

a second support strap having a first end and a second end, said first end being attached to a center front portion of the panty, said second support strap being adapted to extend over a shoulder of the wearer, across the lower back of the wearer, over a hip of the wearer, and under the abdomen of the wearer, wherein the first and second support straps are adapted to crisscross each other at the back of the wearer;

means for connecting the first and second support straps to each other near their second ends;

a first lateral strap having a first end, a second end and a midpoint, said first and second ends being affixed to the first support strap and said midpoint being affixed to a side portion of the panty; and a second lateral strap having a first end, a second end and a midpoint, said first and second ends being affixed to the second support strap and said midpoint being affixed to a side portion of the panty, wherein the lateral straps direct the support straps outward from the neck of the wearer.

8. A garment for supporting the abdomen of a wearer, comprising:

a panty;

a first support strap having a first end and a second end, said first end being attached to a center front portion of the panty, said first support strap being adapted to extend over a shoulder of the wearer, across the lower back of the wearer, and over a hip of the wearer;

a second support strap having a first end and a second end, said first end being attached to a center front portion of the panty and said second support strap being adapted to extend over a shoulder of the wearer, across the lower back of the wearer, over a hip of the wearer, and under the abdomen of the wearer, wherein the first and second support straps are adapted to crisscross each other at the back of the wearer;

means for connecting the first and second support straps to each other near their second ends;

a first lateral strap having a first end, a second end and a midpoint, said first and second ends being affixed to the first support strap and said midpoint being affixed to a side portion of the panty;

a second lateral strap having a first end, a second end and a midpoint, said first and second ends being affixed to the second support strap and said midpoint being affixed to a side portion of the panty, wherein the lateral straps direct the support straps outward from the neck of the wearer;

a reinforcing strap having two ends and designed to wrap under the abdomen of the wearer; and means for affixing the ends of the reinforcing strap to the two support straps near the hips of the wearer.

9. A garment for supporting the abdomen of a wearer, comprising:

a panty;

a first support strap having a first end and a second end, said first end being attached to a center front portion of the panty, said first support strap being adapted to extend over a shoulder of the wearer, across the lower back of the wearer, and over a hip of the wearer;

a second support strap having a first end and a second end, said first end being attached to a center front portion of the panty and said second support strap being adapted to extend over a shoulder of the wearer, across the lower back of the wearer, over a hip of the wearer, and under the abdomen of the wearer, wherein the first and second support straps are adapted to crisscross each other at the back of the wearer;

means for connecting the first and second support straps to each other near their second ends;

a first lateral strap having a first end, a second end and a midpoint, said first and second ends being affixed to the first support strap and said midpoint being affixed to a side portion of the panty;

a second lateral strap having a first end, a second end and a midpoint, said first and second ends being affixed to the second support strap and said midpoint being affixed to a side portion of the panty, wherein the lateral straps direct the support straps outward from the neck of the wearer;

a reinforcing strap having two ends and designed to wrap under the abdomen of the wearer;

means for affixing the ends of the reinforcing strap to the two support straps near the hips of the wearer; and at least one reinforcing ribbon extending from the center front portion of the panty, and attached thereto, to a crotch portion of the panty, and attached thereto, wherein the reinforcing ribbon lends structural support to the panty.

10. A garment for supporting the abdomen of a wearer, comprising:

a panty;

a first support strap having a first end and a second end, said first end being attached to a center front portion of the panty, said first support strap being adapted to extend over a shoulder of the wearer, across the lower back of the wearer, and over a hip of the wearer;

a second support strap having a first end and a second end, said first end being attached to a center front portion of the panty and said second support strap being adapted to extend over a shoulder of the wearer, across the lower back of the wearer, over a hip of the wearer, and under the abdomen of the wearer, wherein the first and second support straps are adapted to crisscross each other at the back of the wearer;

means for connecting the first and second support straps to each other near their second ends;

a first lateral strap having a first end, a second end and a midpoint, said first and second ends being affixed to the first support strap and said midpoint being affixed to a side portion of the panty;

a second lateral strap having a first end, a second end and a midpoint, said first and second ends being affixed to the second support strap and said midpoint being affixed to a side portion of the panty, wherein the lateral straps direct the support straps outward from the neck of the wearer;

a reinforcing strap having two ends and designed to wrap under the abdomen of the wearer;

means for affixing the ends of the reinforcing strap to the two support straps near the hips of the wearer;

at least one reinforcing ribbon extending from the center front portion of the panty, and attached thereto, to a crotch portion of the panty, and attached thereto, wherein the reinforcing ribbon lends structural support to the panty; and wherein an upper edge of the panty extends above the navel of the wearer.

11. A maternity garment for supporting the abdomen of a pregnant woman, comprising:

a panty;

a first support strap having a first end and a second end, said first end being fixed to a center front portion of the panty and said first support strap designed to extend over a shoulder of the women, across the lower back of the woman, and over a hip of the woman;

a second support strap having a first end and a second end, said firs end affixed to a center front portion of the panty and said second support strap designed to extend over a shoulder of the woman, across the lower back of the woman, over a hip of the woman, and under the abdomen of the woman, said first and second support straps being adapted to crisscross each other and are fixedly attached to each other at said crisscross junction and said second ends of the support straps being adapted to overlap each other under the woman's abdomen; and means for adjustably connecting the first and second support straps to each other near their second ends.

12. The maternity garment of claim 11, further comprising a first lateral strap having a first end, a second end and a midpoint, said first and second ends being affixed to the first support strap and said midpoint being affixed to a side portion of the panty; a second lateral strap having a first end, a second end and a midpoint, said first and second ends being affixed to the second support strap and said midpoint being affixed to a side portion of the panty, wherein the lateral straps direct the support straps outward from the neck of the woman.

13. The maternity garment of claim 11, further comprising:

a reinforcing strap having two ends and designed to wrap under the abdomen of the women; and means for affixing the ends of the reinforcing strap to the two support straps near the hips of the woman.

14. The maternity garment of claim 11, further comprising at least one reinforcing ribbon extending from the center front portion of the panty, and attached thereto, to a crotch portion of the panty, and attached thereto, wherein the reinforcing ribbon lends structural support to the panty.

15. The garment of claim 11, further comprising a pair of lateral reinforcing ribbons positioned on the panty lateral to each other, each having a first end and a second end, wherein each first end is attached to an upper side portion of the panty and each second end is attached to a lower front portion of the panty near a crotch portion of the panty.

16. The maternity garment of claim 11 wherein an upper edge of the panty extends above the navel of the woman.

17. A maternity garment for supporting the abdomen of a pregnant woman, comprising:

a panty;

a first support strap having a first end and a second end, said first end being fixed to a center front portion of the panty and said second support strap designed to extend over a shoulder of the woman, across the lower back of the woman, over a hip of the woman;

a second support strap having a first end and a second end, said first end affixed to a center front portion of the panty and said first support strap designed to extend over a shoulder of the woman, across the lower back of the woman, over a hip of the woman, and under the abdomen of the woman, wherein the first and second support straps crisscross each other and are fixedly attached to each other at said crisscross junction;

means for connecting the first and second support straps to each other near their second ends;

a first lateral strap having a first end, a second end and a midpoint, said first and second ends being affixed to the first support strap and said midpoint being affixed to a side portion of the panty; and a second lateral strap having a first end, a second end and a midpoint, said first and second ends being affixed to the second support strap and said midpoint being affixed to a side portion of the panty, wherein the lateral straps direct the support straps outward from the neck of the woman.

18. A maternity garment for supporting the abdomen of a pregnant woman, comprising:

a panty;

a first support strap having a first end and a second end, said first end being fixed to a center front portion of the panty and said first support strap designed to extend over a shoulder of the woman, across the lower back of the woman, and over a hip of the woman;

a second support strap having a first end and a second end, said first end affixed to a center front portion of the panty and said second support strap designed to extend over a shoulder of the woman, across the lower back of the woman, over a hip of the woman, and under the abdomen of the woman, wherein the first and second support straps crisscross each other and are fixedly attached to each other at said crisscross junction;

means for connecting the first and second support straps to each other near their second ends;

a first lateral strap having a first end, a second end and a midpoint, said first and second ends being affixed to the first support strap and said midpoint being affixed to a side portion of the panty;

a second lateral strap having a first end, a second end and a midpoint, said first and second ends being affixed to the second support strap and said midpoint being affixed to a side portion of the panty, wherein the lateral straps direct the support straps outward from the neck of the woman;

a reinforcing strap having two ends and designed to wrap under the abdomen of the woman; and means for affixing the ends of the reinforcing strap to the two support straps near the hips of the woman.

19. A maternity garment for supporting the abdomen of a pregnant woman, comprising:

a panty;

a first support strap having a first end and a second end, said first end being fixed to a center front portion of the panty and said first support strap designed to extend over a shoulder of the woman, across the lower back of the woman, and over a hip of the woman;

a second support strap having a first end and a second end, said first end affixed to a center front portion of the panty and said second support strap designed to extend over a shoulder of the woman, across the lower back of the woman, over a hip of the woman, and under the abdomen of the woman, wherein the first and second support straps crisscross each other and are fixedly attached to each other at said crisscross junction;

means for connecting the first and second support straps to each other near their second ends;

a first lateral strap having a first end, a second end and a midpoint, said first and second ends being affixed to the first support strap and said midpoint being affixed to a side portion of the panty;

a second lateral strap having a first end, a second end and a midpoint, said first and second ends being affixed to the second support strap and said midpoint being affixed to a side portion of the panty, wherein the lateral straps direct the support straps outward from the neck of the woman;

a reinforcing strap having two ends and designed to wrap under the abdomen of the woman;

means for affixing the ends of the reinforcing strap to the two support straps near the hips of the woman; and at least one reinforcing ribbon extending from the center front portion of the panty, and attached thereto, to a crotch portion of the panty, and attached thereto, wherein the reinforcing ribbon lends structural support to the panty.

20. A maternity garment for supporting the abdomen of a pregnant woman, comprising:

a panty;

a first support strap having a first end and a second end, said first end being fixed to a center front portion of the panty and said first support strap designed to extend over a shoulder of the woman, across the lower back of the woman, and over a hip of the woman;

a second support strap having a first end and a second end, said first end affixed to a center front portion of the panty and said second support strap designed to extend over a shoulder of the woman, across the lower back of the woman, over a hip of the woman, and under the abdomen of the woman, wherein the first and second support straps crisscross each other and are fixedly attached to each other at said crisscross junction;

means for connecting the first and second support straps to each other near their second ends;

a first lateral strap having a first end, a second end and a midpoint, said first and second ends being affixed to the first support strap and said midpoint being affixed to a side portion of the panty;

a second lateral strap having a first end, a second end and a midpoint, said first and second ends being affixed to the second support strap and said midpoint being affixed to a side portion of the panty, wherein the lateral straps direct the support straps outward from the neck of the woman;

a reinforcing strap having two ends and designed to wrap under the abdomen of the woman;

means for affixing the ends of the reinforcing strap to the two support straps near the hips of the woman;

at least one reinforcing ribbon extending from the center front portion of the panty, and attached thereto, to a crotch portion of the panty, and attached thereto, wherein the reinforcing ribbon lends structural support to the panty; and wherein an upper edge of the panty extends above the navel of the woman.

* * * * *

UNITED STATES PATENT AND TRADEMARK OFFICE

CERTIFICATE OF CORRECTION

PATENT NO. : 4,789,372

DATED : December 6, 1988

INVENTOR(S) : Trenna R. Wicks

It is certified that error appears in the above-identified patent and that said Letters Patent is hereby corrected as shown below:

In claim 17, column 9, line 26, delete "second" and substitute therefor --first--.

In claim 17, column 9, line 28, following "woman" and before "over" insert --and--.

In claim 17, column 9, line 32, delete "first" and substitute therefor --second--.

Signed and Sealed this

Thirtieth Day of May, 1989

*Attest:*

*Attesting Officer*

DONALD J. QUIGG

*Commissioner of Patents and Trademarks*